US007563133B2

(12) United States Patent
Stein

(10) Patent No.: US 7,563,133 B2
(45) Date of Patent: Jul. 21, 2009

(54) LOW EXTRACTION FORCE CONNECTOR INTERFACE

(75) Inventor: Casey Roy Stein, Scottsdale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 76 days.

(21) Appl. No.: 11/429,001

(22) Filed: May 4, 2006

(65) Prior Publication Data

US 2007/0004276 A1 Jan. 4, 2007

Related U.S. Application Data

(60) Provisional application No. 60/696,004, filed on Jul. 1, 2005.

(51) Int. Cl.
*H01R 9/05* (2006.01)

(52) U.S. Cl. ..... 439/578; 439/675; 439/248; 439/374

(58) Field of Classification Search ..... 439/578, 439/374, 675, 248
See application file for complete search history.

(56) References Cited

U.S. PATENT DOCUMENTS 4,605,269 A * 8/1986 Cohen et al. ..... 439/63
4,697,859 A * 10/1987 Fisher, Jr. ..... 439/246
4,789,351 A 12/1988 Fisher, Jr. et al. ..... 439/248
4,917,630 A * 4/1990 Hubbard ..... 439/578
4,925,403 A 5/1990 Zorzy ..... 439/578
5,074,809 A * 12/1991 Rousseau ..... 439/675
5,329,262 A * 7/1994 Fisher, Jr. ..... 333/33
5,474,470 A * 12/1995 Hammond, Jr. ..... 439/578
6,126,487 A 10/2000 Rosenberger ..... 439/675
6,709,289 B2 * 3/2004 Huber et al. ..... 439/578

OTHER PUBLICATIONS

Department of Defense, "*Interface Standard Radio Frequency Connector Interfaces for MIL-C-3643, MIL-C-3650, MIL-C-3655, MIL-C-25516, MIL-C-26637, MIL-PRF-39012, MIL-PRF-49142, MIL-PRF-55339, MIL-C-83517*", MIL-STD-348A Notice 6, Mar. 14, 2003, pp. Coversheet, 326.1, 326.1a, 326.2, 326.5, 328.1, 328.2, and 328.3.

* cited by examiner

*Primary Examiner*—Truc T Nguyen
*Assistant Examiner*—Xuong M Chung-Trans
(74) *Attorney, Agent, or Firm*—Matthew J. Mason; Joseph M. Homa

(57) ABSTRACT

A male connector interface which requires a low extraction force to remove the male interface from a mating female connector interface. The male connector interface has a tubular housing with an inner surface with a first inner diameter region having an inner diameter and an increased inner diameter region having a first end disposed directly adjacent the first inner diameter region and extending to the distal end of the housing for an axial length, wherein the first inner diameter region and the first end of the increased inner diameter region define a shoulder facing the distal end of the housing, and the increased inner diameter region has a first tapered portion disposed at the first end and increasing in diameter toward the distal end, the first tapered portion defining a first frustoconical portion of the longitudinal bore.

19 Claims, 7 Drawing Sheets

LOW EXTRACTION FORCE CONNECTOR INTERFACE

CROSS-REFERENCE TO RELATED APPLICATIONS

This application claims the benefit of priority under 35 U.S.C. § 119(e) of U.S. Provisional Application Ser. No. 60/696,004 filed on Jul. 1, 2005, the content of which is relied upon and incorporated herein by reference in its entirety.

BACKGROUND OF THE INVENTION

1. Field of the Invention

The present invention relates to push-on Radio Frequency (RF) coaxial connectors, and more particularly to a male RF coaxial push-on connector used for mating with female RF coaxial push-on connectors.

2. Technical Background

Coaxial cable and coaxial cable connectors are often used for transmitting radio-frequency (RF) signals. Examples of standard RF push-on connector interfaces can be found in MIL-STD-348 under SMP and SMPM series interfaces. Typically, male and female push-on connector interfaces are constructed to matingly engage a male and a female with a secure physical connection and a reliable electrical connection.

As illustrated in FIG. 1, to test a device 10 having one or more male smooth bore connector interfaces, such as in FIG. 4, with blind mate connectors 14 having female connector interfaces 12 or so-called female-female bullets, a test connector 16 is provided with a male connector interface (not shown) to engage a corresponding female connector interface 12. Coaxial cables 18 are connected to the test connector 16 and terminate in the male connector interface which is exposed externally on a surface 19 that is capable of engaging the device under test 10. One end of a representative connector 14 with a known female interface 12 is schematically illustrated in FIG. 2 as having a tubular outer housing 20 comprising a tubular body 22 and a plurality of fingers 24 that extend from the tubular body to a leading end 26, and a center terminal 28 disposed within the longitudinal bore 30 of the outer housing 20 and adapted to receive a central terminal of a male connector interface.

Referring again to FIG. 1, a plurality of male connector interfaces, such as shown in FIG. 4, with blind mate connectors 14 is provided on the device under test 10. The test connector 16 and the device 10 are brought together to engage the male and female interfaces. At the conclusion of testing, the test connector 16 and device 10 are moved apart. For known interfaces, even for interfaces which are not mutually locking, the male interface of the device under test 10 and the blind mate connectors 14 of the device under test 10 may not disengage from each other when the test connector 16 and device 10 are moved apart after electrical testing is completed, due to the snug fit between the male and female interfaces. FIG. 3 shows the undesirable condition of three blind mate connectors 14 disengaged from the device under test 10 at the conclusion of testing. In some situations, all of the blind mate connectors could become dislodged from the device under test. This undesirable situation can be exacerbated during rapid testing or automated testing. The situation can occur even for male connector interfaces with a smooth bore, such as the known SMPM male smooth bore interface 1 found on page 328.3 of MIL-STD-348, a portion of which is reproduced in FIG. 4. Increasing the diameter of the smooth bore of the male connector interface to create less spring finger deflection and therefore less force and less friction when the connectors are mated and unmated does not entirely address this issue, because sufficient electrical connection must also be maintained between the interfaces during testing.

SUMMARY OF THE INVENTION

A male connector interface is disclosed herein which requires a low extraction force to remove the male interface from a mating female connector interface. The male connector interface has a tubular housing with an inner surface with a first inner diameter region having an inner diameter and an increased inner diameter region having a first end disposed directly adjacent the first inner diameter region and extending to the distal end of the housing for an axial length, wherein the first inner diameter region and the first end of the increased inner diameter region define a shoulder facing the distal end of the housing, and the increased inner diameter region has a first tapered portion disposed at the first end and increasing in diameter toward the distal end, the first tapered portion defining a first frustoconical portion of the longitudinal bore. The combination of the male connector interface and a female connector interface is also disclosed, as well as a method for testing a device utilizing the interfaces.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
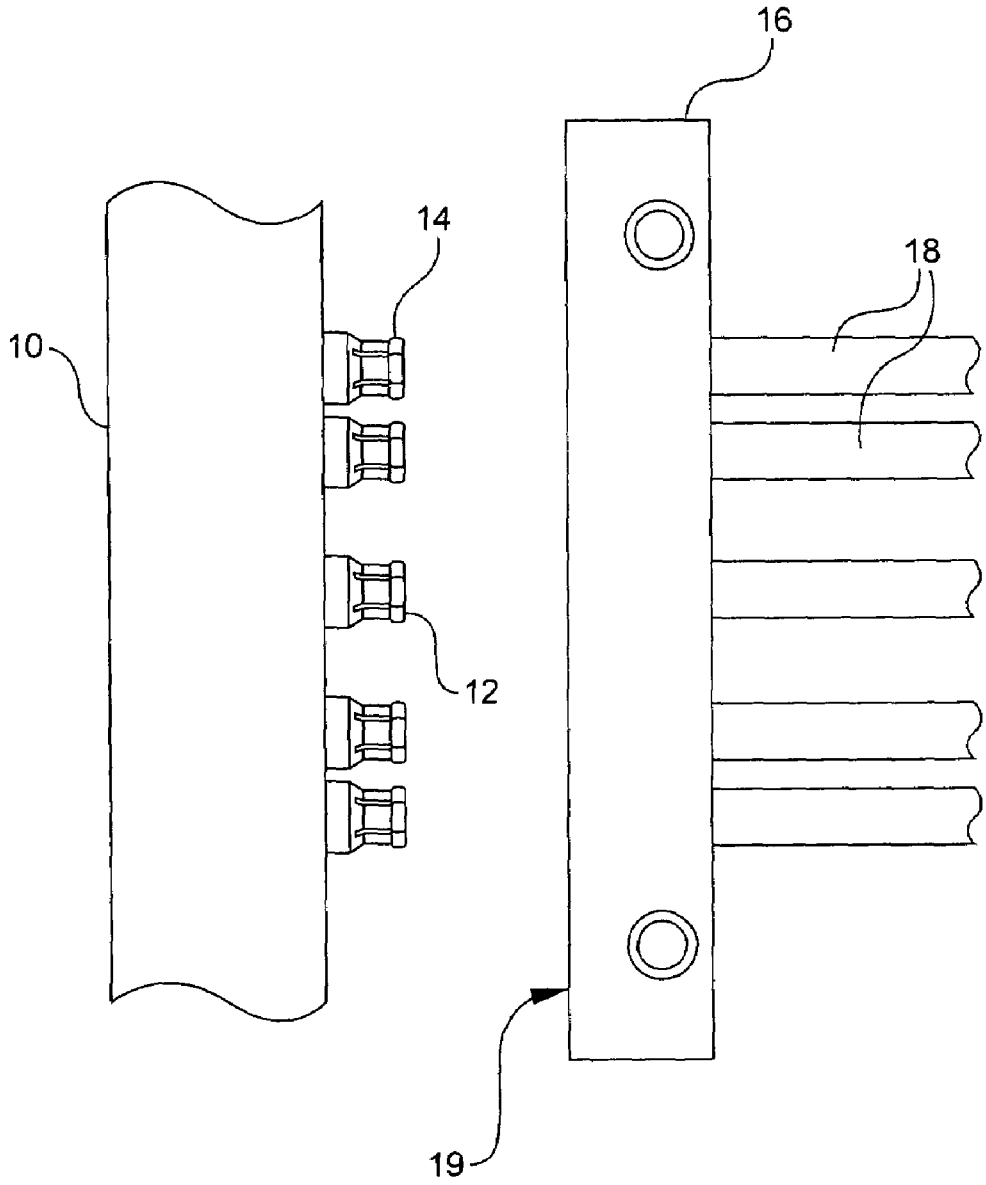
FIG. 1 (Prior Art)
FIG. 1 is a schematic view of a known test setup prior to engagement of a device under test with a test connector, the test connector having male connector interfaces and the device under test having known male interfaces with blind mate connectors having known female connector interfaces previously installed.
Figure 2:
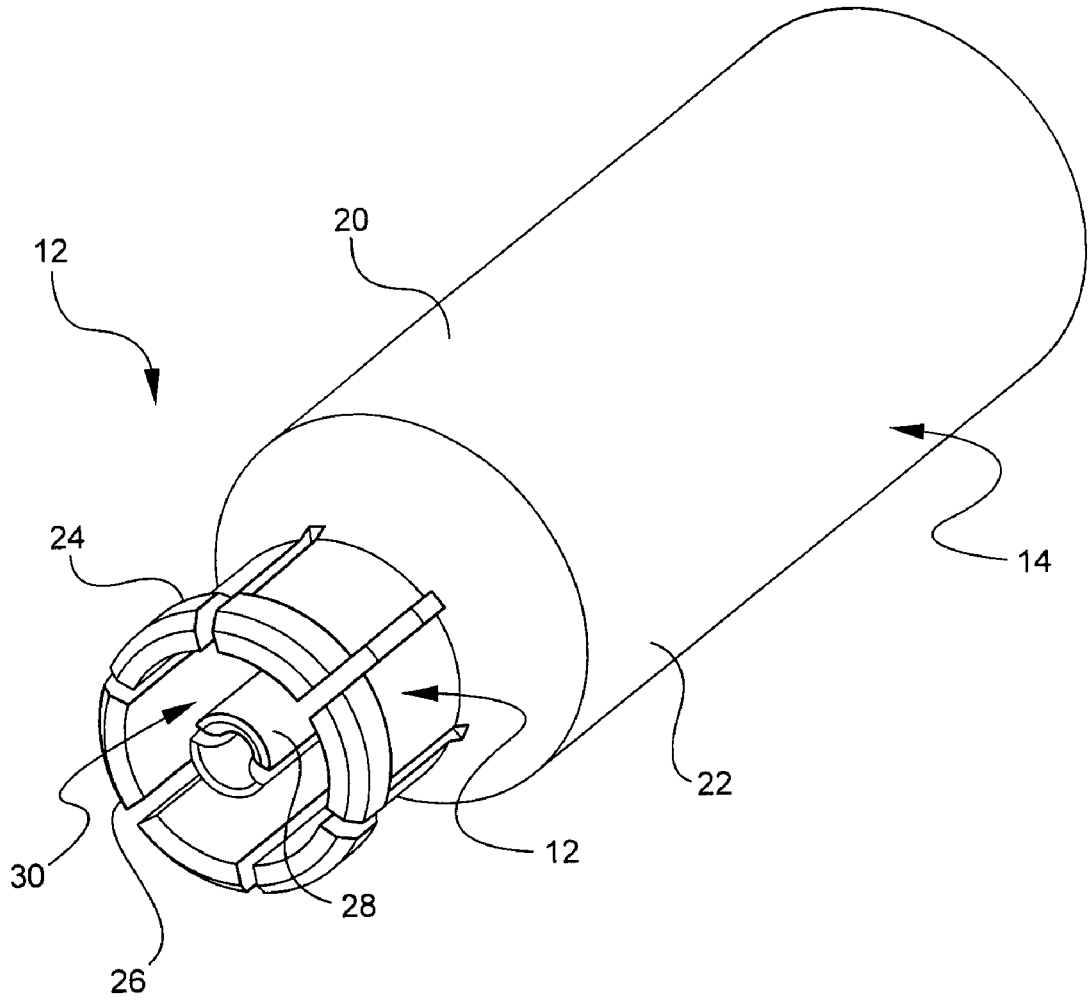
FIG. 2(Prior Art)
FIG. 2 is an isometric view of a connector with a known female connector interface.
Figure 3:
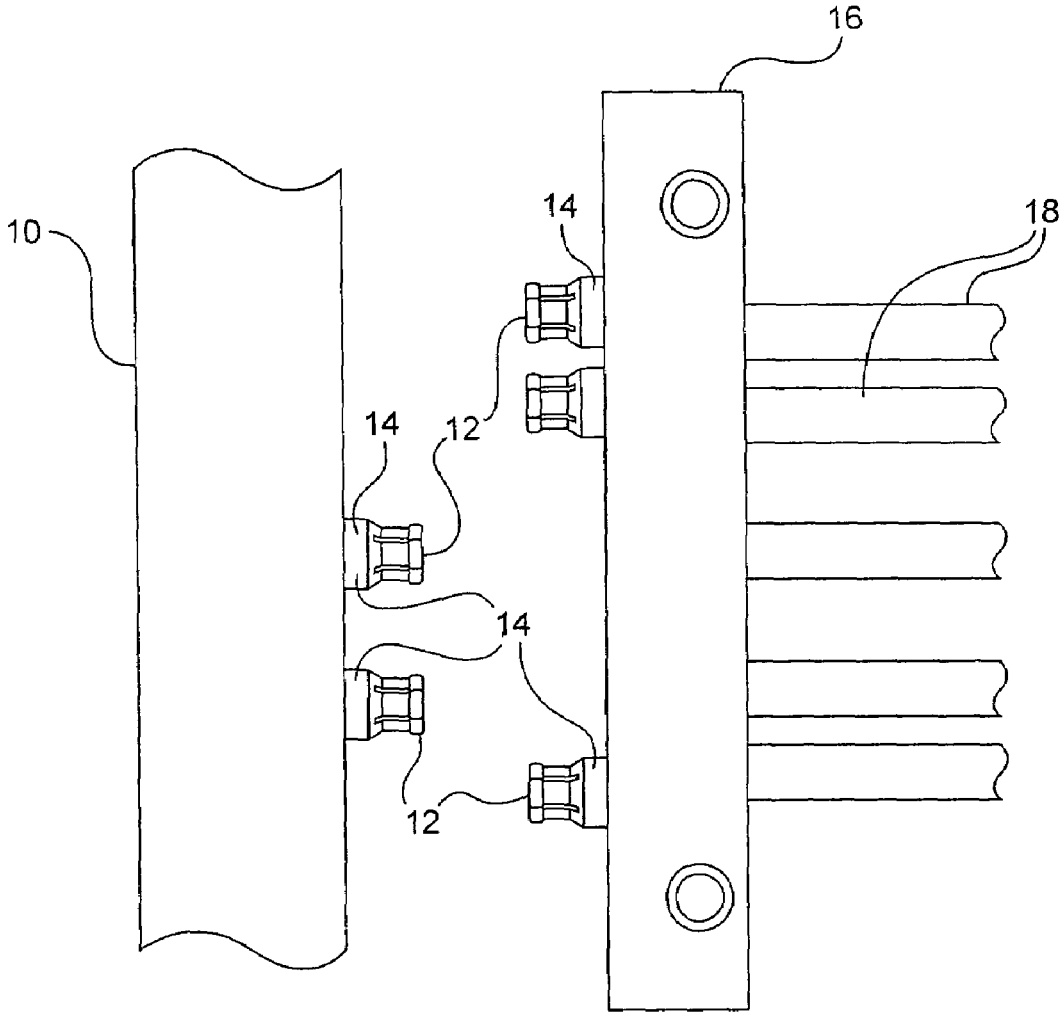
FIG. 3(Prior Art)
FIG. 3 is a schematic view of the test setup of FIG. 1 after engagement of the device under test with the test connector, wherein some of the blind mate connectors are separated from the device under test and carried away by the test connector subsequent to testing.
Figure 4:
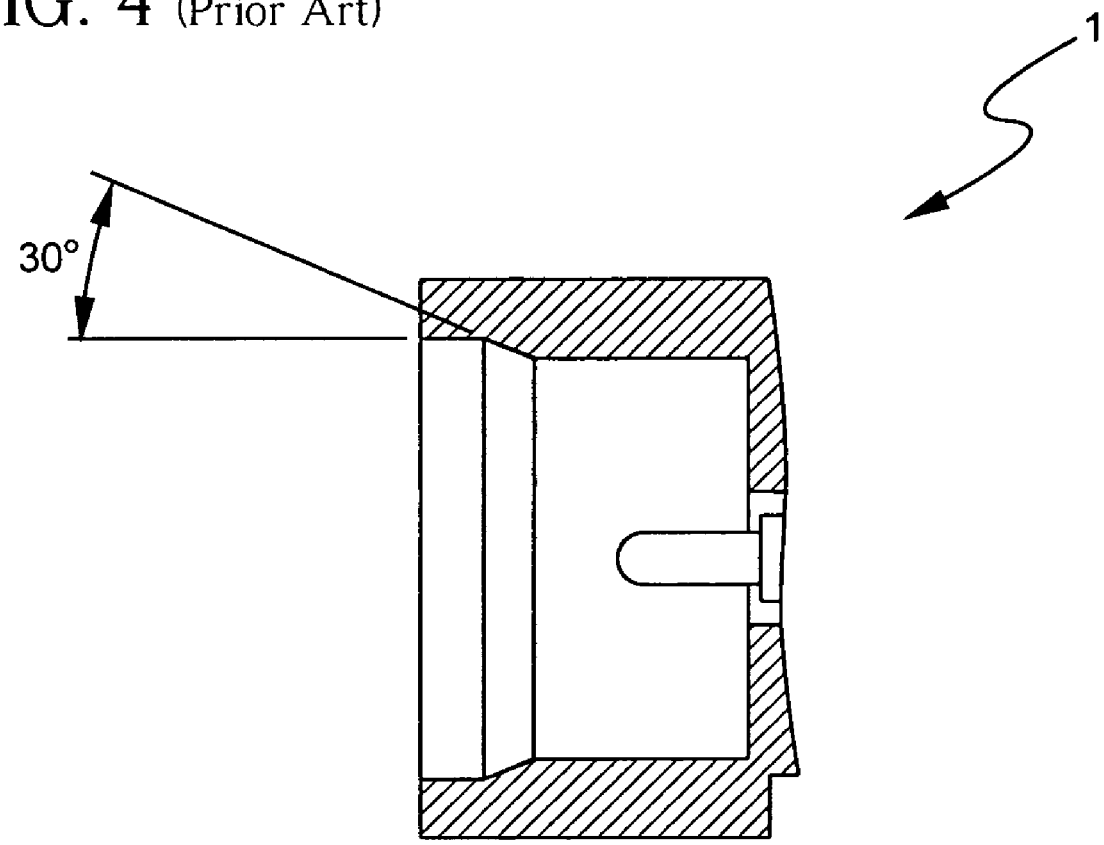
FIG. 4 (Prior Art)
FIG. 4 is a side cutaway view of a known smooth bore male connector interface.

Reference will now be made in detail to the present preferred embodiment(s) of the invention, examples of which are illustrated in the accompanying drawings. Whenever possible, the same reference numerals will be used throughout the drawings to refer to the same or like parts.

Figure 5:
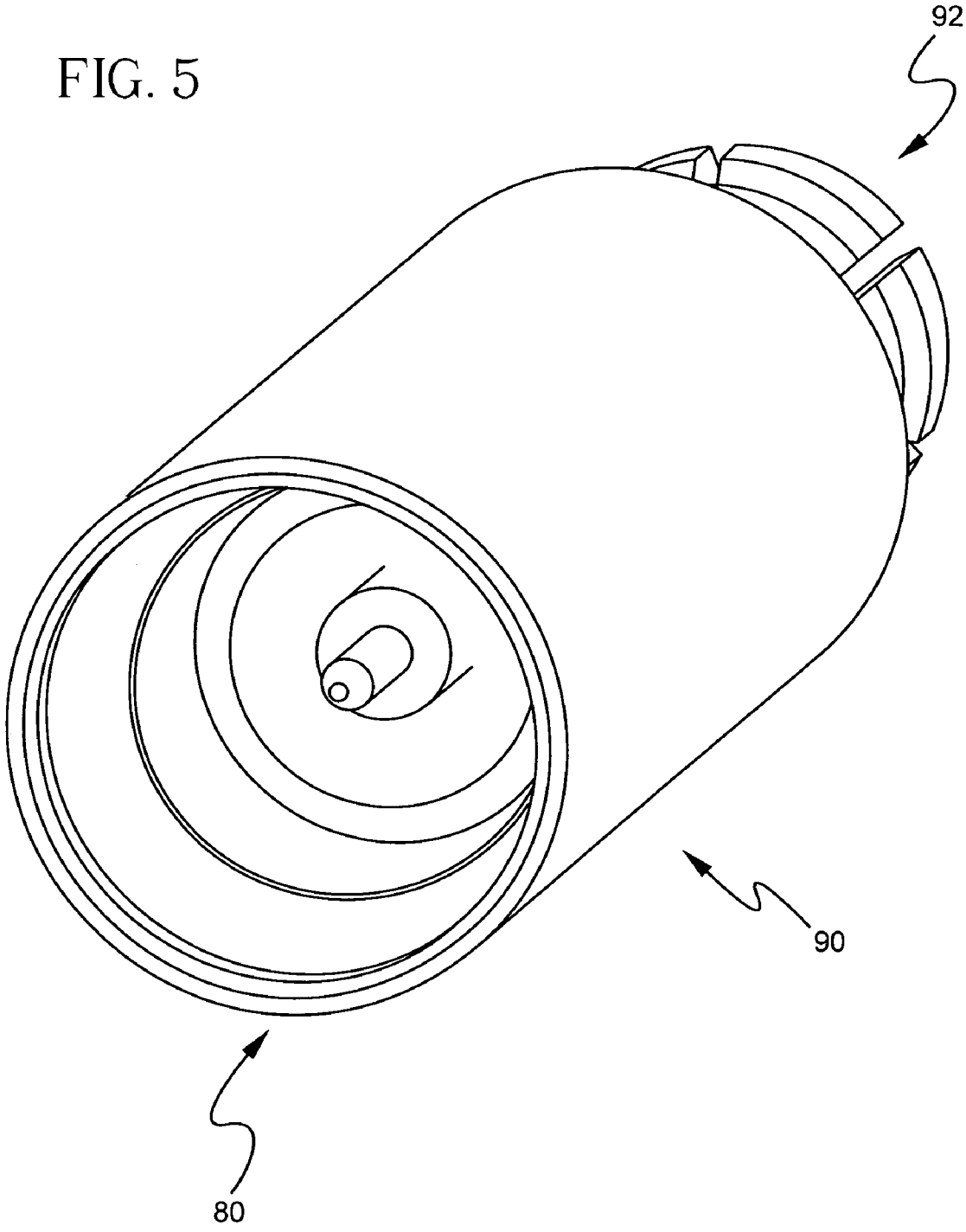
FIG. 5 is an isometric view of a connector with a preferred embodiment of the male connector interface of the present invention.
Figure 6:
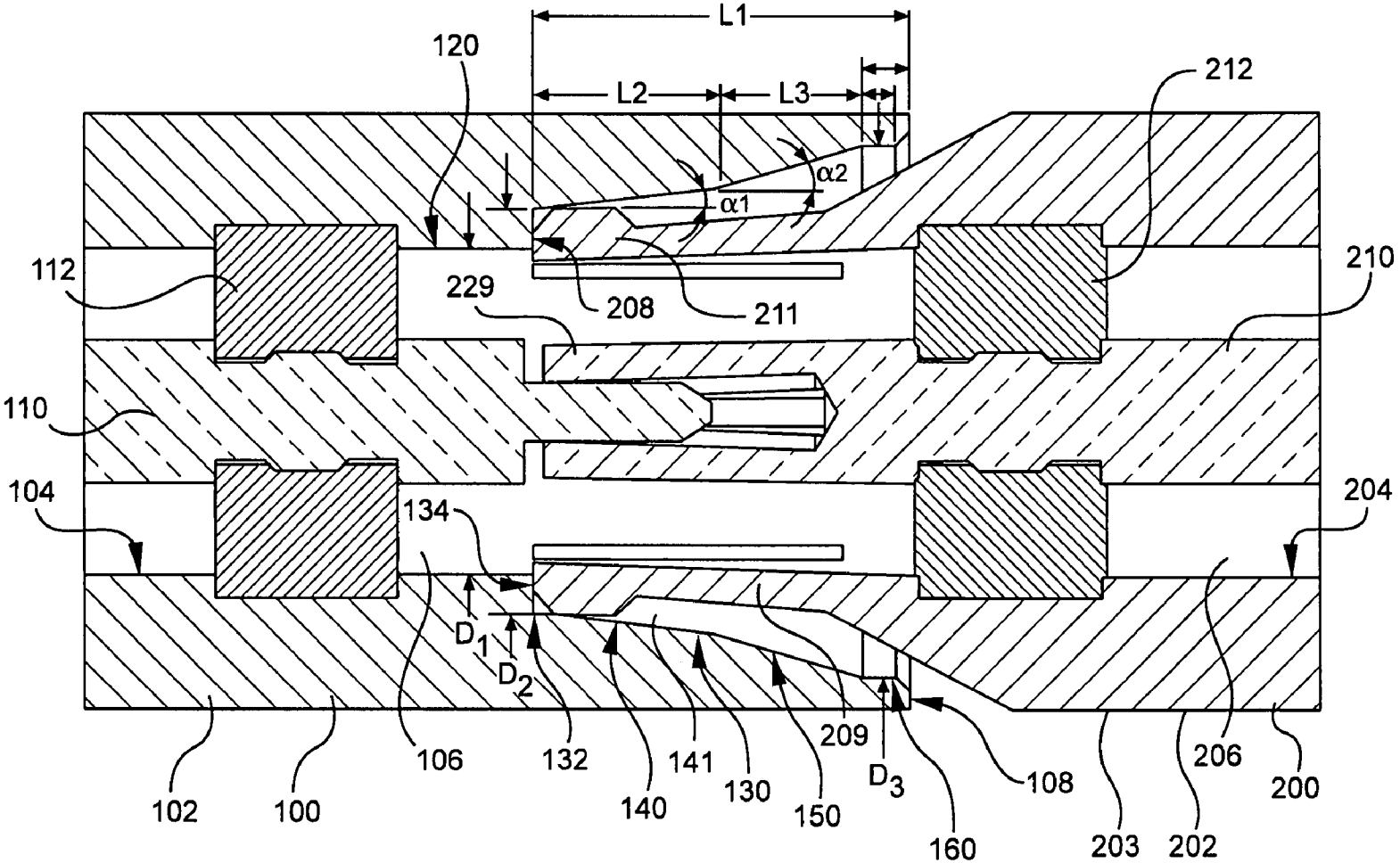
FIG. 6 is a side cutaway view of a preferred embodiment of the male connector interface of the present invention in mating engagement with a known female connector interface.

FIG. 5 illustrates one preferred embodiment of a male connector interface 80 of the present invention which, in the present example, forms part of a connector 90 which also has a female interface 92 opposite to the male interface. FIG. 6 illustrates a preferred embodiment of a male connector interface 100 of the present invention in mating engagement with a female connector interface.

Referring to FIG. 6, the male connector interface 100 comprises a tubular housing 102 comprising an inner surface 104 that defines a longitudinal bore 106 along a longitudinal axis of the housing 102. In this embodiment, the bore 106 is a through-bore, although in other embodiments the bore may not pass all the way through the body. The housing 102 has a distal end 108. The housing 102 is made from an electrically conductive material, preferably metal, and serves as an outer conductor. In preferred embodiments, the housing 102 is made from brass, copper, kovar, or stainless steel. A central terminal 110 is disposed within the longitudinal bore 106 of the housing 102. The central terminal 110 is made from an electrically conductive material, preferably metal, and serves as an inner conductor. In preferred embodiments, the central terminal 110 is made from brass, copper, kovar, or stainless steel. A dielectric support member 112 is disposed on the inner surface of the housing and holds the central terminal 110 within the longitudinal bore 106 and away from the inner surface 104 of the housing 102, such that the central terminal 110 does not contact (directly contact) the inner surface 104 of the housing 102. The support member 112 is made from an electrically nonconductive material, such as ptfe (Teflon®) or glass such as Corning 7070 glass. The inner surface 104 of the housing 102 comprises a first inner diameter region 120 having an inner diameter D1, and an increased inner diameter region 130 having a first end 132 disposed directly adjacent the first inner diameter region 120 and extending to the distal end 108 of the housing 102 for an axial distance L1. The first end 132 has an inner diameter D2, and D2>D1. The first inner diameter region 120 and the first end 132 of the increased inner diameter region 130 define a step or a shoulder 134 facing the distal end 108 of the housing 102. The increased inner diameter region 130 comprises a first tapered portion 140 disposed at the first end 132, and extending from the first end 132 for an axial distance L2, and having increasing inner diameters within the axial distance L2 with increasing longitudinal distance away from the first end 132. Preferably, the shoulder 134 is substantially orthogonal to the longitudinal axis, even more preferably the shoulder 134 is perpendicular to the longitudinal axis. The first tapered portion 140 defines a first generally frustoconical bore portion 141 of the longitudinal bore 106. Preferably, the first tapered portion 140 has a monotonically increasing inner diameter with axial length in the direction of the distal end 108. In other embodiments, the tapered portion 140 has a series of minute steps, such as steps that have a depth smaller than the depth of the shoulder 134.

Preferably, $0.1 \leqq L2/L1 \leqq 1.0$. In some preferred embodiments, $0.2 \leqq L2/L1 \leqq 0.8$. In other preferred embodiments, $0.3 \leqq L2/L1 \leqq 0.7$. In the preferred embodiment illustrated in FIG. 6, L2/L1 is about 0.5. In some embodiments, the first tapered portion 140 extends all the way to distal end 108.

The increased inner diameter region 130 here also comprises an optional second tapered portion 150 extending axially for a length L3.

The ratio L3/L1 is greater than or equal to 0 and less than (1−L2/L1). In some preferred embodiments, $0.2 \leqq L3/L1 \leqq 0.8$. In other preferred embodiments, $0.3 \leqq L3/L1 < 0.6$. In the preferred embodiment illustrated in FIG. 6, L3/L1 is about 0.4, and L4/L1 is about 0.1.

The first tapered portion 140 is disposed directly adjacent to and extending away from the shoulder 134. The first tapered portion 140 defines a first acute angle $\alpha 1$ with the longitudinal axis. Preferably $0.5° \leqq \alpha_1 \leqq 30°$, more preferably $1° \leqq \alpha_1 \leqq 25°$, even more preferably $2° \leqq \alpha_1 \leqq 10°$. In the embodiment of FIG. 6, $\alpha 1$ is about 6°. The second tapered portion 150 defines a second acute angle $\alpha 2$ with the longitudinal axis, wherein $\alpha 2 > \alpha 1$. Preferably $\alpha_1 \leqq \alpha_2 \leqq 45°$, more preferably $\alpha_1 \leqq \alpha_2 \leqq 30°$. In the embodiment of FIG. 6, $\alpha 2$ is about 16°. The second tapered portion 150 is disposed between the first tapered portion 140 and the distal end 108. The increased diameter region 130 further comprises an optional third inner surface section having a substantially constant diameter D3, and D3>D2>D1. The increased diameter region 130 further comprises an optional chamfered inner surface section 160 disposed at the distal end 108 of the housing 102.

FIG. 6 illustrates a combination of one preferred embodiment of a male connector interface 100 and a mating female connector interface 200, the female connector interface comprising a tubular outer housing 202 comprising an inner surface 204 defining a longitudinal bore 206, preferably a throughbore, along a longitudinal axis of the outer housing 202. The outer housing 202 comprises a tubular body 203 and a plurality of fingers 209 that extend from the tubular body 203 to a leading end 208. A center terminal 210 is disposed within the longitudinal bore 206 of the outer housing 202 and adapted to receive the central terminal 110 of the male connector interface 100. The outer housing 202 and the center terminal 210 are made from electrically conductive material, preferably metal, such as brass, copper, kovar, or stainless steel. A dielectric support member 212 is disposed on the inner surface 204 of the outer housing 202 and holds the center terminal 210 within the longitudinal bore 206 and away from the inner surface 204 of the outer housing 202, wherein the center terminal 210 does not contact (directly contact) the inner surface 204 of the outer housing 202. The support member 210 is made from an electrically nonconductive material, such as ptfe (Teflon®) or glass such as Corning 7070 glass. The increased inner diameter region 130 of the male connector interface 100 is adapted to receive the plurality of fingers 209. Each of the plurality of fingers 209 has a protrusion 211 disposed at or near the leading end 208. The protrusion 211 may comprise a chamfered or frustoconical outer surface portion as illustrated in FIG. 6, or the protrusion may have a more bulbous or spherical contour. The protrusion 211 has an outer surface that mates with at least part of the first tapered portion 140 of the male connector interface 100. The contour of at least part of the protrusion 211 and the contour of the first tapered portion 140 preferably match. Preferably, the protrusion 211 contacts the first tapered portion 140 when the male and female connector interfaces are fully mated together. Alternatively, or in addition, the leading end 208 of the tubular outer housing 202 contacts the shoulder 134 when the male and female connector interfaces are fully mated together. For some embodiments, I have found that the leading end of the tubular outer housing could be spaced away from the shoulder by a small axial gap. Even more preferably, the protrusion contacts both the tapered portion, and the leading end of the tubular outer housing contacts the shoulder, when the male and female connector interfaces are fully mated together, as shown in FIG. 6.

In use, a first body (such as a connector) which comprises a male connector interface and a second body (such as another connector) which comprises a female connector interface capable of mating with the male connector interface and moved into mutual engagement. The first body and/or the second body could have a cable mounted opposite its respective interface, or the side opposite to the interface could be configured to attach to a PCB board, a metal panel, a wave guide, or other components. The body (or connector) could comprise two interfaces to form an adapter. The plurality of fingers 209 of the outer housing 202 of the female interface 200 are guided into engagement with the increased inner diameter region 130 of the male interface 100, and the male central terminal 110 of the male interface is guided into engagement with the female center terminal 210 of the female interface. In some preferred embodiments, the female center terminal 210 comprises radially inwardly biased flexible fingers 229 that form a socket that receives the central terminal 110 of the male interface 100. The fingers 229 are spread apart by the entry of the central terminal 110 to allow a snug but releasable physical fit while allowing a good electrical contact to be established therebetween. In some preferred embodiments, the plurality of fingers 209 of the outer housing 202 of the female interface 200 are spread radially outward and are disposed at an angle with respect to the longitudinal axis prior to engagement in a freestanding state, and then engagement between the male 100 and female 200 interfaces, and in particular engagement between the protrusions of the fingers 209 and the increased inner diameter region 130 of the male interface, causes the fingers 209 to deflect radially inwardly. Preferably, the increased inner diameter region 130 and the plurality of fingers 209 are mutually adapted to allow the inner surfaces of the plurality of fingers 209 to lie parallel to or at a precise acute angle to an outer surface of the center terminal 210 when the male and female connector interfaces are fully mated together, as illustrated in FIG. 6.

Figure 7:
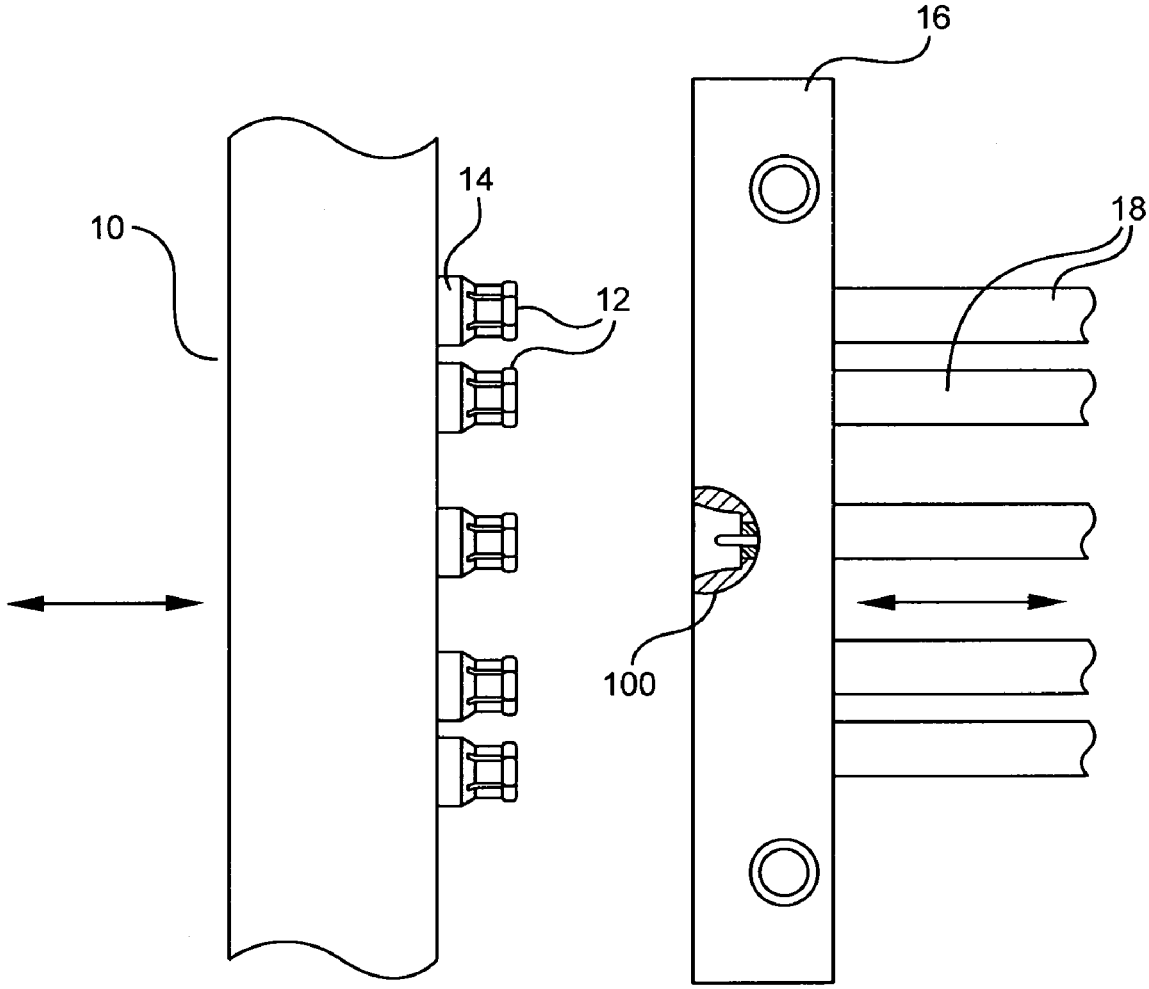
FIG. 7 is a schematic view of a test setup similar to that of FIG. 1 but the test connector has male connector interfaces, representative of the pre-test state before engagement of the test connector and the device under test, and also representative of the post-test state after disengagement of the test connector and the device under test, wherein none of the blind mate connectors are separated from the device under test and carried away by the test connector subsequent to testing.

Referring to FIG. 7, the present invention relates to a method of testing a device-under-test with a test connector comprising the male connector interface of the present invention. The device under test has coaxial connectors each with a male connector interface with a blind mate connector preinstalled. A mating male connector interface for each of the female interfaces is adapted to mate with respective female connector interfaces. For illustration purposes, only one of the male interfaces is shown by cutaway of the test connector. The method comprises the sequential steps of moving the test connector toward the device under test to engage the male connector interface with the female connector interface such that the device under test and the test connector are electrically connected to each other, transmitting test information through the male connector interface and female connector interface, and moving the test connector away from the device under test such that the device under test and the test connector are electrically disconnected from each other, wherein the blind mate connector is disengaged from the male connector interface. The male and female interfaces are temporarily brought together with a sufficient axial force, but the interfaces are easily separable upon termination of the axial force. FIG. 7 schematically represents both the "before engagement and testing" and "after testing and disengagement", wherein all of the connectors that were initially installed on the device under test also remained on the device under test after conclusion of the test. The non-sticking engagement between the male and female interfaces is provided by the male interface of the present invention.

The present invention also relates to a test interface apparatus for interconnecting a device under test with an analyzer and supply for testing the device (which could include one or cables), the device comprising a female connector interface, the apparatus comprising a test structure having an interface surface adapted to receive the device under test and having the male connector interface of the present invention, wherein the male connector interface is adapted to engage the female interface.

The male connector interface of the present invention is particularly suited for testing purposes because it provides a non-locking, temporary connection between male and female interfaces to allow a good physical and electrical contact during a test wherein a sufficient axial force is applied to engage the male and female interfaces, but which also allows rapid and easy disengagement of the male and female interfaces upon removal of that axial force. Thus, the male connector interface is easily separable from the female connector interface upon termination of the axial force that keeps the male and female interfaces in mutual engagement during testing.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A male connector interface comprising:

a tubular housing comprising an inner surface defining a longitudinal bore along a longitudinal axis of the housing, the housing having a distal end;

a central terminal disposed within the longitudinal bore of the housing; and a support member disposed on the inner surface of the housing and holding the central terminal within the longitudinal bore;

wherein the inner surface of the housing comprises:

a first inner diameter region having an inner diameter D1; and an increased inner diameter region having a first end disposed directly adjacent the first inner diameter region and extending to the distal end of the housing for an axial length L1;

wherein the first end has an inner diameter D2, and D2>D1, wherein the distal end has an inner diameter D3, and D3>D2, wherein the first inner diameter region and the first end of the increased inner diameter region define a shoulder facing the distal end of the housing, and wherein the increased inner diameter region comprises a first tapered portion disposed at the first end and increasing in diameter toward the distal end for an axial length L2, the first tapered portion defining a first frustoconical portion of the longitudinal bore and wherein the first tapered portion lies at the first acute angle $\alpha$1 with the longitudinal axis, and wherein the increased diameter region further comprises a second tapered portion defining a second acute angle $\alpha 2$ with the longitudinal axis, wherein $\alpha 2 > \alpha 1$, the second tapered portion defining a second frustoconical portion of the longitudinal bore, and wherein the second tapered portion is disposed between the first tapered portion and the distal end.

2. The interface of claim 1 wherein $0.1 \leqq L2/L1 \leqq 1.0$.

3. The interface of claim 1 wherein the shoulder is substantially orthogonal to the longitudinal axis.

4. The interface of claim 1 wherein the second tapered portion extends for an axial length, L3, wherein L3/L1 is greater than or equal to 0 and less than (1−L2/L1).

5. The interface of claim 4 wherein $0.2 \leqq L2/L1 < 0.8$.

6. The interface of claim 1 wherein the increased diameter region further comprises a third inner surface section having a substantially constant diameter D4, and D4>D3>D2>D1.

7. The interface of claim 6 wherein the increased diameter region further comprises a chamfered inner surface section disposed at the distal end of the housing.

8. A method of testing a device under test with a test connector comprising the male connector interface of claim 1, the device under test comprising a female connector interface, wherein the male connector interface is adapted to mate with the female connector interface, the method comprising the sequential steps of:

moving the test connector toward the device under test to engage the male connector interface with the female connector interface such that the device under test and the test connector are electrically connected to each other;

transmitting test information through the male connector interface and female connector interface;

moving the test connector away from the device under test such that the device under test and the test connector are electrically disconnected from each other, wherein the female connector interface is disengaged from the male connector interface.

9. The method of claim 8 wherein the device under test comprises a coaxial connector comprising a second male connector interface and a blind mate connector, wherein the second male connector interface is installed on the blind mate connector, and wherein the female connector interface is part of the blind mate connector.

10. The interface of claim 1, wherein $2° \leqq \alpha_i \leqq 10°$.

11. The interface of claim 10, wherein $0.3 \leqq L2/L1 \leqq 0.7$.

12. The combination of the male connector interface of claim 1 and a mating female connector interface, the female connector interface comprising a tubular outer housing comprising an inner surface defining a longitudinal bore along a longitudinal axis of the outer housing, the outer housing comprising a tubular body and a plurality of fingers that extend from the tubular body to a leading end, a center terminal disposed within the longitudinal bore of the outer housing and adapted to receive the central terminal of the male connector interface, and a support member disposed on the inner surface of the outer housing and holding the center terminal within the longitudinal bore, and wherein the increased inner diameter region of the male connector interface is adapted to receive the plurality of fingers.

13. The interface of claim 12 wherein each of the plurality of fingers has a protrusion disposed at or near the leading end.

14. The interface of claim 13 wherein the protrusion has an outer surface that mates with at least part of the tapered portion of the male connector interface.

15. The interface of claim 13 wherein the protrusion contacts the tapered portion when the male and female connector interfaces are fully mated together.

16. The interface of claim 13 wherein the leading end of the tubular outer housing contacts the shoulder when the male and female connector interfaces are fully mated together.

17. The interface of claim 12 wherein the increased inner diameter region and the plurality of fingers are mutually adapted to allow the inner surfaces of the plurality of fingers to lie parallel to an outer surface of the center terminal when the male and female connector interfaces are fully mated together.

18. The interface of claim 12 wherein the increased inner diameter region and the plurality of fingers are mutually adapted to allow the inner surfaces of the plurality of fingers to lie at a predetermined acute angle with respect to an outer surface of the center terminal when the male and female connector interfaces are fully mated together.

19. The interface of claim 12 wherein the plurality of fingers are radially spread apart prior to mutual engagement between the male and female connector interfaces.

* * * * *